US006367203B1

(12) United States Patent
Graham et al.

(10) Patent No.: US 6,367,203 B1
(45) Date of Patent: Apr. 9, 2002

(54) RUPTURE PANEL

(75) Inventors: James R. Graham, Tulsa; Tom P. Miller, Broken Arrow, both of OK (US)

(73) Assignee: Oklahoma Safety Equipment Co., Inc., OK (US)

( * ) Notice: Subject to any disclaimer, the term of this patent is extended or adjusted under 35 U.S.C. 154(b) by 0 days.

(21) Appl. No.: 09/658,351

(22) Filed: Sep. 11, 2000

(51) Int. Cl.[7] ..... E04H 14/00; E04H 9/00

(52) U.S. Cl. ..... 52/1; 52/98; 52/99; 52/100; 52/208; 52/202; 220/89.1; 220/89; 220/89.2; 220/89.3; 220/207; 137/68.1; 137/70

(58) Field of Search ..... 52/1, 98, 99, 100, 52/208, 200, 202; 220/89.1, 89, 89.2, 89.3, 207; 137/68.1, 70

(56) References Cited

U.S. PATENT DOCUMENTS

| | | | | | |
|---|---|---|---|---|---|
| 4,067,154 | A | | 1/1978 | Fike, Jr. | 52/99 |
| 4,612,739 | A | * | 9/1986 | Wilson | 52/1 |
| 4,656,793 | A | | 4/1987 | Fons | 52/98 |
| 4,750,303 | A | | 6/1988 | Mullen | 52/98 |
| 4,777,974 | A | * | 10/1988 | Swift et al. | 137/14 |
| 4,787,180 | A | | 11/1988 | Robinson et al. | 52/1 |
| 4,821,909 | A | | 4/1989 | Hibler et al. | 220/207 |
| 5,036,632 | A | | 8/1991 | Short, III et al. | 52/1 |
| 6,070,365 | A | | 6/2000 | Leonard | 52/1 |

* cited by examiner

*Primary Examiner*—Carl D. Friedman
*Assistant Examiner*—Chi Nguyen
(74) *Attorney, Agent, or Firm*—Garvey, Smith, Nehrbass & Doody, LLC

(57) ABSTRACT

A rupture panel for relieving an excess pressure differential between the interior and exterior of a vessel having a wall and an opening through the wall includes a first frame section connected to the vessel wall at the opening and a pair of pressure relief panels mounted to the frame, each panel having a stitched portion, the stitched portions providing opening capability on both vacuum and burst pressure control (or on either vacuum or burst pressure control). A pair of sealing members that sandwich the pair of pressure relief panels there between are provided, one of the sealing members engaging one of the pressure relief panels, the other sealing member engaging the other pressure relief panel. Each of the sealing members has a sealing surface that covers a stitched portion of an adjacent relief panel. A second frame section connects to the first frame section and connections are provided that join the first and second frame sections together, clamping the pressure relief panels and sealing members there between.

26 Claims, 2 Drawing Sheets

RUPTURE PANEL

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to rupture disks and panels, and more particularly to an improved rupture panel arrangement. Even more particularly, the present invention relates to an improved rupture panel that features a unique sealing design that does not require a sealing membrane or gasket for pressure loading of a central metal membrane. The present invention even more particularly relates to an improved rupture panel construction that utilizes an overlap feature for the circumferential stitches of the central metal membrane to provide both the seal and additional structural support at the weakest spot of the pressure containing metal membrane.

2. General Background of the Invention

Many patents have issued that relate to rupture disks. Some of these patents relate to rupture panels that include a larger, often rectangular or square (or other) shaped panel member having a peripheral frame or border that supports it. An example of such a rupture panel can be seen in the Fike U.S. Pat. No. 4,067,154. The '154 patent discloses a flexible, low-mass, non-fragmenting burst member or panel which is said to be extremely predictable and essentially instantaneous in operation, even at low burst pressures, in order to safely vent and protect pressure vessels such as bag houses or the like from the potentially catastrophic effects of internal explosions or adverse high-pressure conditions. The panel structure preferably includes a thin metallic substrate having a pattern of tape directly applied thereto, with a coating of epoxy paint over the tape pattern and substrate; sharp-breaking, shear burst lines are thereby produced along the edges of the tape pattern which ensures that the panel will instantaneously vent a pressure vessel through essentially the entire area of full vent opening, thus giving a degree of operational predictability impossible to attain with conventional burst-type venting structures.

U.S. Pat. No. 4,612,739 discloses a low pressure venting panel that acts to safely vent a pressure vessel, such as a bag house, from overpressure conditions. The venting panel is said to be particularly responsive and predictable at low pressures. The panel includes a thin rupture body with a central group of apertures and slit lines emanating from the apertures. A thin sealing membrane is bonded to one surface of the rupture body at least in the area of the slits. The characteristics of the sealing membrane are said to enable the membrane to resist expansion in the area of the slits when pressure is applied to the rupture body, thereby resisting rupture of the membrane up to the design repture limit of the venting panel. Various aperture patterns in the center of the rupture body are provided to facilitate predictable opening. The slits are divided into segments connected by bridges to help prevent the slits from separating and the sealing membrane from creeping through the slits prior to rupture. Protective strips adjacent the slits are positioned between the rupture body and the sealing membrane to reduce creep of the membrane through the slits prior to rupture. A vacuum support grid is provided for the panel to support the sealing membrane against a vacuum acting thereon opposite the rupture body.

In the Fons U.S. Pat. No. 4,656,793, a cover plate is retained in a rubber elastic sealing clamping section and is supported by at least one counter support constituted by a lever arm which will be swung from its supporting position when the load limit is exceeded.

A rupture panel in the form of a silo explosion door is disclosed in U.S. Pat. No. 4,750,303. The explosion door serves as a safety protection apparatus to prevent damage resulting from an explosion within a silo from inadvertently generated gaseous pressures.

The Robinson U.S. Pat. No. 4,787,180 provides a vibration resistant rupturable pressure relief member for protecting structure subject to vibration from reaching an overpressure condition. The rupturable pressure relief member is comprised of a rupture panel having an elongated concave-convex bulged portion formed therein and having a score pattern on a side thereof which includes an elongated score extending longitudinally across the bulged portion the ends of which connect with additional divergent scores forming opposing V-shapes.

In U.S. Pat. No. 4,821,909 there is provided a hygienic pressure relief panel unit which is said to reliably rupture at a predetermined pressure in order to prevent buildup of dangerous pressure within protected structure such as a vessel or the like defining an enclosed space, which prevents media passage there through before rupture, and which is supposed to present a sanitary, easily cleanable surface toward the vessel interior in order to inhibit accumulation of food particles, dust or the like. The preferred panel unit includes a slotted stainless steel panel with the slots configured as a line of weakness for separation at a predetermined pressure, a sheet of PTFE material prepared on one side thereof to present an adhesive bonding surface, and an adhesive coupling the sheet and the panel, whereby the panel unit can be placed in a covering relationship with the vent opening of the protected structured in order to present the outer face of the PTFE sheet toward the vessel interior. The panel can include a series of slotted apertures defined there through configured to present a line of weakness defining three sides of a rectangle. The line of weakness defines the predetermined amount of pressure at which the panel ruptures.

The Short U.S. Pat. No. 5,036,632 discloses a pressure relief panel assembly that includes a single rupture panel which includes a domed portion connected to a peripheral flat flange portion and has at least one slit formed therein defining a hinged blow-out part. The hinged blow-out part is connected to the remaining part of the rupture panel by an unslit hinge area and a plurality of rupture tabs.

A multiple dome single-panel explosion vent is disclosed in the Leonard U.S. Pat. No. 6,070,365. The explosion vent includes a peripheral flange configured for attachment to the enclosure around the opening, a pressure relief panel positioned within and hingedly connected to the flange, and a plurality of connectors or rupture tab assemblies connecting the unhinged portion of the pressure relief panel to the flange. The connectors break when the enclosure is subjected to pressure build-up for permitting the panel to shift outwardly from the enclosure for uncovering the opening in the enclosure. Rivets are provided for attaching the rupture tab assemblies to the pressure relief panel which function to provide additional panel support and minimize localized bending of the rupture tabs forming a part of assemblies when the explosion vent is subjected to vacuum conditions, but do not interfere with rupture of the tabs and opening of the panel at a relatively low burst pressure. The pressure relief panel has a plurality of domed sections presenting at least one valley defining bridge there between. The domed sections and bridges cooperate to stiffen the panel so that it more uniformly distributes force on the connectors, causing all of the connectors to break at approximately the same time so that the panel more consistently opens at a selected burst pressure level.

BRIEF SUMMARY OF THE INVENTION

The present invention provides an improved rupture panel arrangement that does not require a sealing membrane or gasket for pressure loading the central metal membrane.

The present invention utilizes an overlap membrane that provides the seal as well as additional structural support at the weakest spot of this pressure containing metal membrane.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
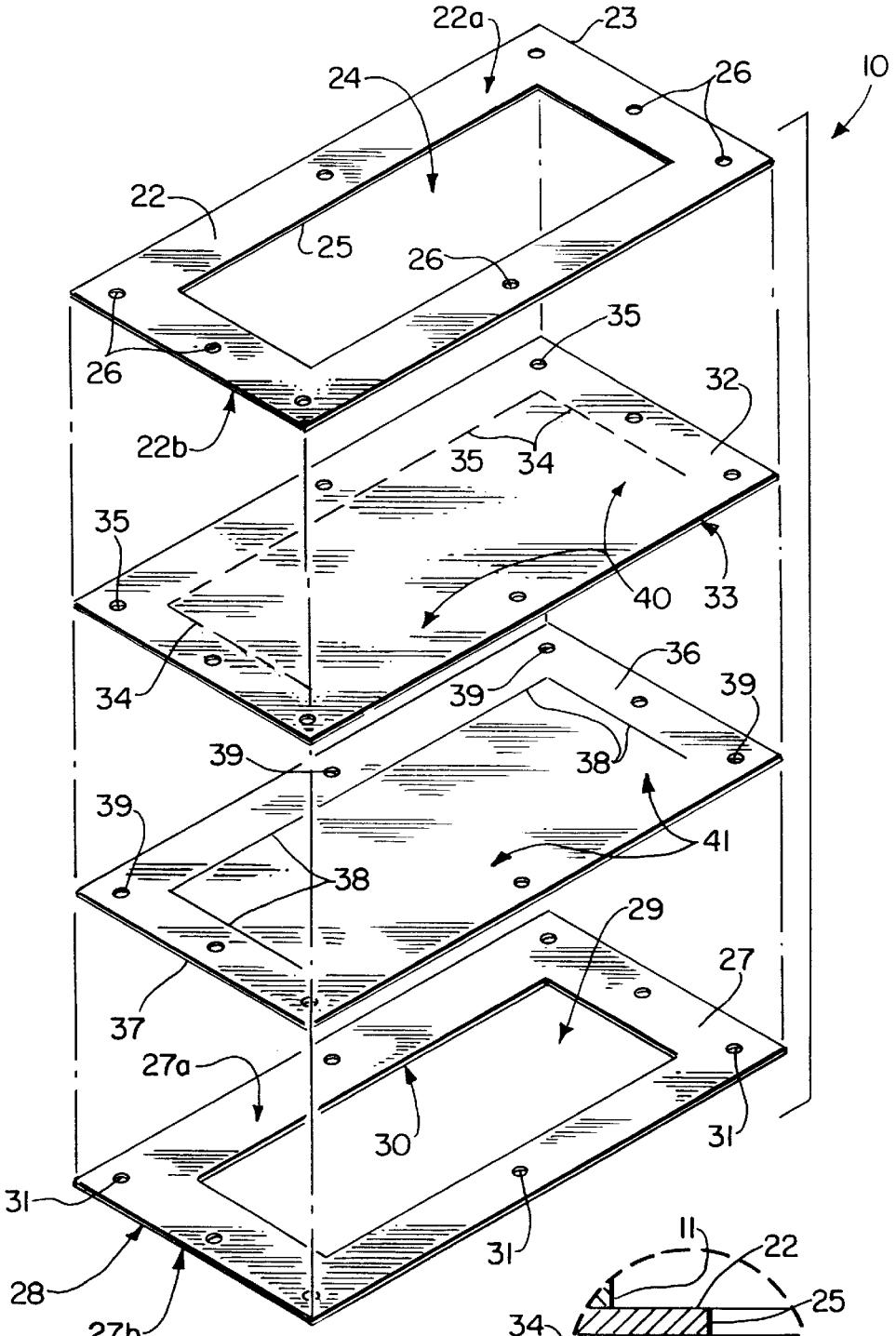
FIG. 1 is a perspective, exploded view of the preferred embodiment of the apparatus of the present invention.
Figure 2:
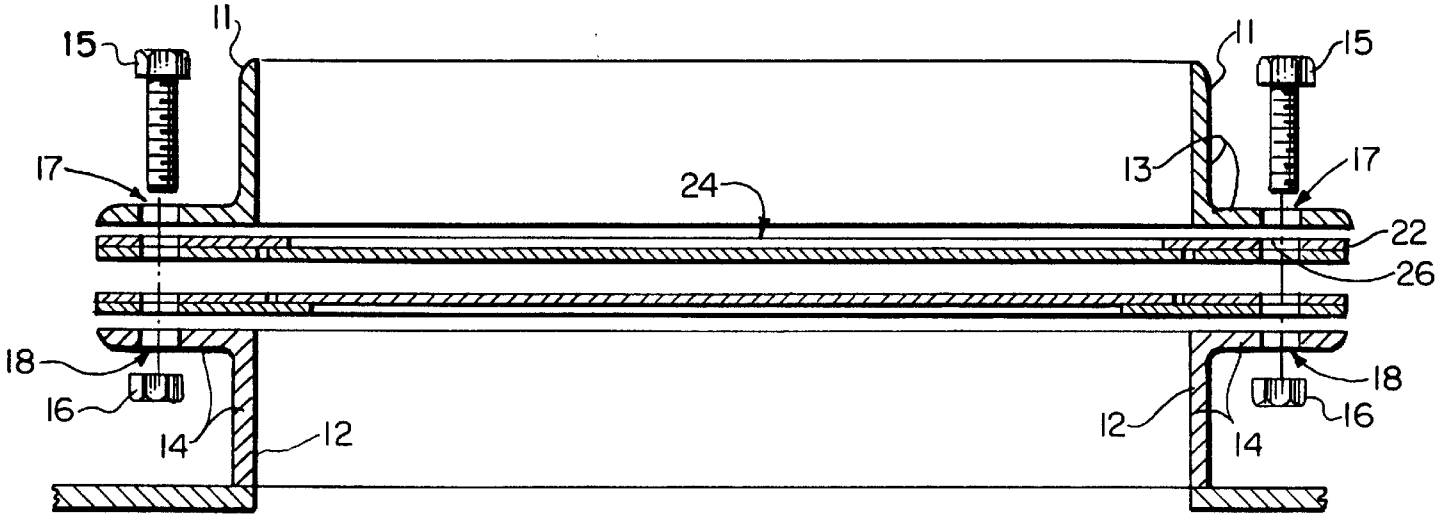
FIG. 2 is a sectional elevation, exploded view of the preferred embodiment of the apparatus of the present invention.
Figure 3:
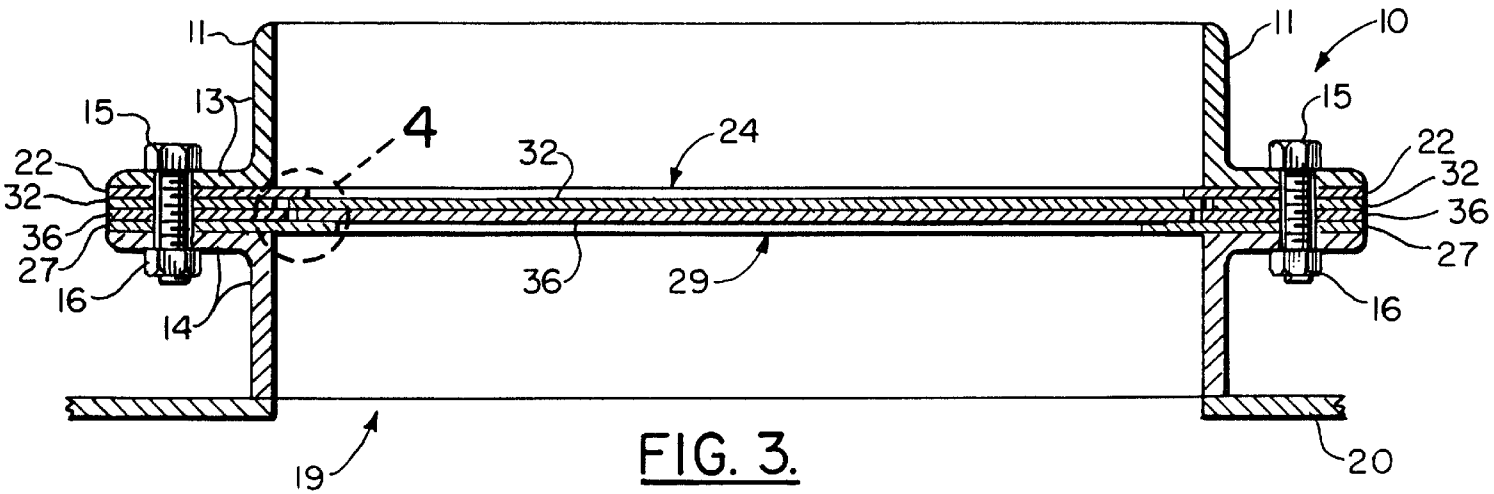
FIG. 3 is a sectional elevation view of the preferred embodiment of the apparatus of the present invention.

FIGS. 1–4 show the preferred embodiment of the apparatus of the present invention, designated generally by the numeral 10 in FIGS. 1, 2 and 3. Rupture panel apparatus 10 includes an outlet frame 11, an inlet frame 12, and an attachment (for example welded) to pressure vessel 20. In FIGS. 2 and 3, pressure vessel 20 is shown having a wall 21 which is only partially shown in FIGS. 2 and 3 for purposes of simplicity and clarity. The pressure vessel 20 has an opening 19 in wall 21 to which the rupture panel apparatus 10 of the present invention is attached.

In FIGS. 2 and 3, rupture panel apparatus 10 has an inlet frame 12. The frame 12 can be comprised of a plurality of flanged beams 14 that are welded together. An outlet frame 11 likewise can be constructed of a plurality of flanged beams 13 that are welded together.

Each of the frames 11, 12 are bolted together in a sandwiched fashion together with a plurality of panels 22, 27 and rupture disks 32, 37. In FIGS. 2 and 3, the outlet frame 11 fits against outlet panel 22 having opposed surfaces 22A, 22B as shown. Similarly, the inlet frame 12 fits against inlet panel 27 which has opposed surfaces 27A, 27B. In between the inlet panel 27 and outlet panel 22 there are provided a pair of rupture disks or membranes 32, 37. The outlet panel 22 has a central opening 24, periphery 23, and an edge 25 that faces the opening 24 as shown in FIG. 1. Outlet panel 22 also provides a plurality of bolt hole openings 26 through which an assembly bolt 15 passes as shown in FIGS. 2 and 3.

Inlet panel 27 provides a periphery 28, central opening 29 bounded by edge 30, and a plurality of bolt hole openings 31 that receive bolt 15 upon assembly.

The rupture disks 32, 37 are shown in FIG. 1, each including a periphery, stitching and a plurality of openings through which bolts 15 pass as shown in FIGS. 1–3. The rupture disk 32 has periphery 33 and stitching 34. A plurality of openings 35 receive assembly bolts 15. The rupture disk 36 has a periphery 37, stitching 38, and a plurality of openings 39 through which assembly bolts 15 pass upon assembly. The stitching 34, 38 includes solid material and cuts or slits spaced at intervals as shown in FIG. 1. It is the slit between the solid metal stitches of the metal membrane which can potentially be a leak path.

Figure 4:
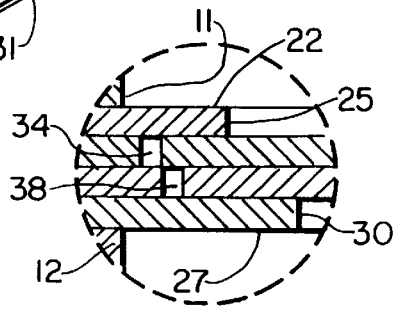
FIG. 4 is a fragmentary, enlarged sectional view of the preferred embodiment of the apparatus of the present invention.

As shown in FIGS. 2–4, outlet panel 22 and inlet panel 27 cover the stitching 34, 38 respectively of the rupture disks 32, 37 when the apparatus 10 is assembled as shown in FIGS. 3 and 4. The apparatus 10 of the present invention thus provides an improved construction for a rupture panel that does not require a sealing membrane or gasket for pressure loading of the central metal membranes or rupture disks 32, 36. Instead, the present invention utilizes an overlap feature as shown in FIG. 4, wherein the circumferential stitching 34, 38 of the central metal membranes or disks 32, 36 respectively provide the seal as well as additional structural support at the weakest spot of these pressure containing metal membranes 32, 37. Thus, the inlet panel 27 and the outlet panel 22 provide both a sealing function and a support function for the rupture disk membranes 32, 36. The stitching 34, 38 that is shown for each of the membranes 32, 36 provide opening capability on both vacuum and burst pressure control for the top section, namely rupture disk 32.

Stitches that are provided in prior art type rupture panels are typically sealed with a flexible fluorocarbon membrane that has minimal contribution to burst pressure but does indeed provide the necessary sealing function.

While the surface finish of both the top (outlet) panel 22 and the bottom (inlet) panel 27 is adequate to provide a seal normally acceptable in most applications, a bubble tight seal can also be achieved by the addition of a silicone sealing compound which has very minimal impact on burst pressure when applied in the slit of only the top section (outlet) panel 22.

There is a consideration relating to the amount of overlap between the outlet panel 22 and the inlet panel 27 and their adjacent membranes, namely rupture disk 32 and rupture disk 36. If there is not sufficient overlap, no seal is achieved. Additionally, the thicknesses of the membranes 32, 36 for both positive pressure and vacuum have an impact on the load bearing capability of each. These thicknesses of rupture disk membranes 32, 36 are utilized in the adjustment or finding phase of the burst pressure or vacuum resisting capability of each panel that is to be manufactured and sold. The support frames 11, 12 can be structural angle frames. There only requirement is to provide sufficient rigidity to contain the outlet panel 22, inlet panel 27, and rupture disk membranes 32, 36.

The stitches 34, 38 are preferably provided only along three sides. Thus a hinge is provided on the remaining side to assist in providing a full opening. A hinge 40 is provided on rupture disk membrane 32. A hinge 41 is provided on rupture disk panel 36. The hinge can consist for example of three or four stitches each of one to three inches in length, depending upon the size of the particular rupture disk membrane 32, 36. These hinge stitches are connected with slits and are designed to keep the central portion of the metal membrane 32 or 36 in tact, i.e., no fragmentation during rupture.

With regard to pressure ranges, a rupture panel 10 of the present invention typically operates between zero and 10 p.s.i.g. maximum due to the forces exerted on the structures they protect.

Rupture panel apparatus 10 can be used, for example, on bag houses, duct work carrying coal dust or particles in power generation plants, food processing equipment handling explosive mixtures of wheat flour, rice flour, starch, etc., as well as chemical plants producing feed stocks that are in dust form from petroleum products. These are exemplary only.

It should be understood that the normal configuration of rupture panel 10 is a rectangular shape. However, rupture panel apparatus 10 can also be square or circular depending upon the application.

The following is a list of suitable parts and materials for the various elements of the preferred embodiment of the present invention.

PARTS LIST

PARTS LIST

| PART NUMBER | DESCRIPTION |
|---|---|
| 10 | rupture panel |
| 11 | outlet frame |
| 12 | inlet frame |
| 13 | flanged beam |
| 14 | flanged beam |
| 15 | bolt |
| 16 | nut |
| 17 | opening |
| 18 | opening |
| 19 | opening |
| 20 | pressure vessel |
| 21 | wall |
| 22 | outlet panel |
| 22a | surface |
| 22b | surface |
| 23 | periphery |
| 24 | central opening |
| 25 | edge |
| 26 | opening |
| 27 | inlet panel |
| 27a | surface |
| 27b | surface |
| 28 | periphery |
| 29 | central opening |
| 30 | edge |
| 31 | opening |
| 32 | rupture disk membrane |
| 33 | periphery |
| 34 | stitching |
| 35 | opening |
| 36 | rupture disk membrane |
| 37 | periphery |
| 38 | stitching |
| 39 | opening |
| 40 | hinge |
| 41 | hinge |

The foregoing embodiments are presented by way of example only; the scope of the present invention is to be limited only by the following claims.

What is claimed is:

1. A rupture panel for relieving an excess pressure differential between the interior and the exterior of a vessel having a wall and an opening through the wall, comprising:

a) a first frame section connected to the vessel wall at the opening and having a central opening;

b) a pair of pressure relief panels mounted to the frame, each panel having a periphery and a peripheral stitched portion positioned next to the periphery, the stitched portions of the respective panels providing opening capability on vacuum and burst pressure control;

c) a pair of sealing members that sandwich the pair of pressure relief panels there between, one of the sealing members engaging one of the pressure relief panels, the other sealing member engaging the other pressure relief panel, each of the sealing members having a central opening;

d) each of the sealing members having a periphery and a peripheral sealing surface surrounding its central opening that covers a peripheral stitched portion of an adjacent pressure relief panel;

e) a second frame section that connects to the first frame section, the second frame section having a central opening; and f) connectors that join the first and second frame sections together, clamping the pressure relief panels and sealing member there between.

2. The rupture panel of claim 1 wherein the stitched portion comprises a circuitous stitch that extends around a substantial portion of the periphery of each sealing member.

3. The rupture panel of claim 1 wherein the stitched portion comprises a circuitous stitch that extends around most of the periphery of each sealing member.

4. The rupture panel of claim 1 wherein the connectors comprise a plurality of bolted connections.

5. The rupture panel of claim 1 wherein each frame section has a central opening, and wherein the stitched portion of each pressure relief panel communicates with a frame section central opening.

6. The rupture panel of claim 5 wherein each frame section has an inner surface at the opening, and the sealing members extend inwardly of the inner surfaces of the frame members.

7. The rupture panel of claim 1 wherein each frame section has an inner surface next to the frame section opening, and the sealing members each have an edge that extends inwardly of the inner surfaces of the frame members.

8. The rupture panel of claim 7 wherein the stitched portion is positioned in between the inner surface of the frame sections and the pressure relief panel openings.

9. A rupture panel for relieving an excess pressure differential between the interior and the exterior of a vessel having a wall and an opening through the wall, comprising:

a) a first frame section connected to the vessel wall at the opening, and having a frame section opening;

b) a pair of pressure relief panels mounted to the frame section, each panel having a periphery and a peripheral stitched portion next to the periphery, the stitched portions of the panels providing opening capability on either vacuum or burst pressure control;

c) a pair of sealing members that sandwich the pair of pressure relief panels there between, one of the sealing members engaging one of the pressure relief panels, the other sealing member engaging the other pressure relief panel;

d) each of the sealing members having a sealing surface that covers and seals a stitched portion of an adjacent pressure relief panel;

e) a second frame section that connects to the first frame section, and having a frame section opening; and f) connectors that join the first and second frame sections together, clamping the pressure relief panels and sealing member there between.

10. The rupture panel of claim 9 wherein one of the sealing members has a central opening.

11. The rupture panel of claim 9 wherein both of the sealing members has a central opening.

12. The rupture panel of claim 4 wherein the stitched portion comprises a circuitous stitch that extends around a substantial portion of the periphery of each sealing member.

13. The rupture panel of claim 9 wherein the stitched portion comprises a circuitous stitch that extends around most of the periphery of each sealing member.

14. The rupture panel of claim 9 wherein the connectors comprise a plurality of bolted connections.

15. The rupture panel of claim 9 wherein the stitched portion of each pressure relief panel communicates with the central frame openings.

16. The rupture panel of claim 15 wherein each frame section has an inner surface at the frame section opening, and the sealing members extend inwardly of the inner surfaces of the frame sections.

17. The rupture panel of claim 9 wherein each frame section has an inner surface at the frame section opening, and the sealing members extend inwardly of the inner surfaces of the frame sections.

18. The rupture panel of claim 17 wherein the peripheral stitched portion of each pressure relief panel is positioned in between the inner surface of the frame sections and the pressure relief panel openings.

19. A rupture panel for relieving an excess pressure differential between the interior and the exterior of a vessel having a wall and an opening through the wall, comprising:

a) a supportive frame that includes a first frame section connected to the vessel wall at the opening and a second frame section, each of the frame sections having a central flow opening;

b) a pressure relief panel assembly that is mounted to the supportive frame, and generally in between the frame sections, the panel assembly including:

i) a pair of relief panels, each having a periphery that has a peripheral stitched portion, the stitched portions providing opening capability on vacuum and burst pressure control;

ii) a pair of sealing members that sandwich the pair of relief panels there between, one of the sealing members engaging one of the pressure relief panels and the first frame section, the other sealing member engaging the other pressure relief panel and the second frame section;

c) each of the sealing members having a sealing surface that covers a peripheral stitched portion of an adjacent pressure relief panel; and d) connectors that join the first and second frame sections together, clamping the pressure relief panels and sealing member there between.

20. The rupture panel of claim 19 wherein one of the sealing members has a central opening.

21. The rupture panel of claim 19 wherein both of the sealing members has a central opening.

22. The rupture panel of claim 19 wherein the stitched portion comprises a circuitous stitch that extends around a substantial portion of the periphery of each sealing member.

23. The rupture panel of claim 19 wherein the stitched portion comprises a circuitous stitch that extends around most of the periphery of each sealing member.

24. The rupture panel of claim 19 wherein the connectors comprise a plurality of bolted connections.

25. The rupture panel of claim 19 wherein each of the supported frames is generally rectangular in shape.

26. The rupture panel of claim 19 wherein the panel assembly has a generally rectangular shape.

* * * * *